United States Patent [19]

Bengtsson et al.

[11] Patent Number: 4,756,799

[45] Date of Patent: Jul. 12, 1988

[54] METHOD OF MANUFACTURING BLEACHED CHEMIMECHANICAL AND SEMICHEMICAL FIBRE PULP BY MEANS OF A ONE-STAGE IMPREGNATION PROCESS

[75] Inventors: Goran Bengtsson, Liljegangen 5, S-44005 Nodinge; Rune Simonson, Sotenasvagen 64, S-43364 Partille; Roland Agnemo, Ornskoldsvik, all of Sweden

[73] Assignees: Eka AB, Swite; Goran Bengtsson, Nodinge; Rune Simonson, Partille, all of Sweden

[21] Appl. No.: 839,022

[22] Filed: Mar. 12, 1986

[30] Foreign Application Priority Data

Mar. 13, 1985 [SE] Sweden ..... 8501246

[51] Int. Cl.[4] ..... D21B 1/02; D21B 1/04; D21C 3/00; D21C 9/10

[52] U.S. Cl. ..... 162/25; 162/27; 162/28; 162/78; 162/90

[58] Field of Search ..... 162/78, 27, 25, 28, 162/90

[56] References Cited

U.S. PATENT DOCUMENTS 4,160,693 7/1979 Lindahl et al. ..... 162/78 X
4,187,141 2/1980 Ahrel ..... 162/78 X
4,486,267 12/1984 Prusas ..... 162/25
4,599,138 7/1986 Lindahl ..... 162/28 X

FOREIGN PATENT DOCUMENTS 2606718 9/1976 Fed. Rep. of Germany .
303088 8/1968 Sweden .
82007568 2/1982 Sweden .

*Primary Examiner*—Peter Chin
*Assistant Examiner*—Thi Dang
*Attorney, Agent, or Firm*—Young & Thompson

[57] ABSTRACT

In accordance with the invention a chemimechanical pulp is produced from lignocellulosic material, for example wood chips, by subjecting the material to a process in which it is steamed, impregnated with alkali and peroxide, drained, pre-heated, refined and bleached. The material is impregnated in a single stage with a solution containing alkali and peroxide. Subsequent to passing an intermediate drainage and reaction stage, the material is pre-heated to a temperature of from about 50° C., but not above 100° C. The material is then refined in one or two stages. The material can be impregnated by immersing the same in the impregnating solution for a period of up to 20 minutes at a temperature of 15°-60° C., or by compressing the material in a screw press and permitting the compressed material to expand in the impregnating solution. The optimal brightness for a given peroxide charge is achieved by a balanced division of the peroxide charge between the chip impregnating stage and the bleaching stage.

6 Claims, 1 Drawing Sheet

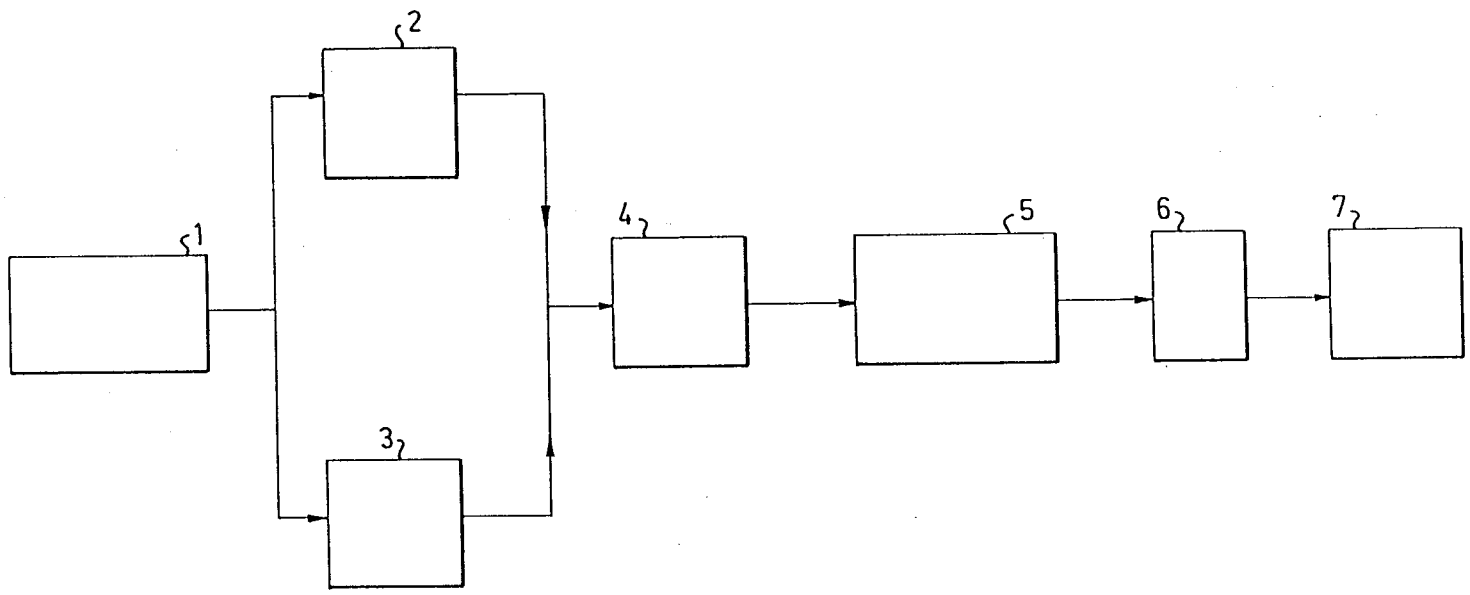
1
2
3
4
5
6
7

METHOD OF MANUFACTURING BLEACHED CHEMIMECHANICAL AND SEMICHEMICAL FIBRE PULP BY MEANS OF A ONE-STAGE IMPREGNATION PROCESS

The shortage of wood suitable for manufacturing pulp is becoming more and more acute, and in the future the use of short-fibre pulp for paper manufacturing purposes will increase as a result of the decreasing availability of conventional, long-fibre raw materials. The energy costs incurred in the manufacture of pulp are also rapidly increasing. Thus, the problem is two-fold and encompasses the need for improved methods which will facilitate a wider use of suitable varieties of wood within the industry, and which will satisfy the need for more economical and more effective refining and bleaching methods.

The object of the present invention is to solve and/or alleviate these problems prevailing in the pulp and paper industries. This object is achieved by a novel method of pre-treating wood chips.

Initially, wood pulp was produced by pressing a log against a rotating grindstone or pulpstone, to provide a finely divided fibre pulp. Due to the fact that the resultant pulp contained all the lignin present in the log, the yield obtained with such methods was in excess of 95%. The pulp also has a high shive content and low strength values, owing to the fact that grinding greatly reduces the lengths of the fibres.

In order to raise the quality of wood pulp, the so-called chemical methods, sulphite, sulphate and soda, were developed. These methods involve chipping the wood and treating the wood chips with chemicals at elevated temperatures and pressures. The lignin and also part of the carbohydrates present are released in the ensuing digestion process, and the pulp yield is normally about 45–50%. The pulps are then bleached in various sequences with chlorine, alkali, oxygen-gas, chlorine dioxide, hydrogen peroxide or hypochlorite, in order to remove residual lignin and other pigmented impurities.

The chemical pulps have extremely good strength properties and a high brightness value. These attributes, however, are obtained at the cost of low yields and the highly negative effect produced on the environment by the effluent from the bleaching department.

This had led in recent years to intensive development work aimed at producing mechanical pulps in high yields, ≦90%, and high brightness values, and with strength properties approaching those of the chemical pulps, while at the same time retaining the opacity and bulk properties unique to the mechanical pulps.

This development work has progressed in stages via Refiner Pulp (RMP), Thermomechanical Pulp (TMP), to the present variants of Chemimechanical Pulps (CMP, CTMP). Such pulps are used today in the manufacture of fluff, tissue and paperboard qualities.

The present invention relates to a novel, low-energy method of producing high yield chemimechanical pulp having a final brightness value not previously achieved, and a pulp which in addition to the traditional ranges of use can also be used to produce, for example, fine-paper qualities, due to the high brightness values attainable.

In accordance with the invention, the starting material used may be lignocellolusic fibre material which has been chopped or disintegrated into chips, debris or coarse fibre pulp, referred to hereinafter generally as chips. The chemical treatment of the chips, impregnation, has been effected with an aqueous solution of alkali and some kind of peroxides. Impregnation is effected by immersing chips in impregnating solution or with apparatus of the screw-press type, such as a Sprout-Waldron plug screw feeder, or a Sunds-Defibrator "Prex". Other types of apparatus may be used, however. The chips are advantageously treated with steam, steamed, prior to impregnation, although the result desired is not contingent on such steaming of the chips.

It has long been known that the alkali treatment of lignocellulosic fibre material softens the material as a result of chemical interaction. This softening of the material is beneficial, since the original geometric appearance of the fibres is retained during the refining processes more readily than would otherwise be the case. Fibres can also be separated more completely from a softened material, thereby reducing the content of undesirable fibre material, such as shives.

During the process of softening the fibre material with alkali, some of the alkali charged to the process is consumed by the reaction with acid components in the wood, such as uronic acid groups and acetyl groups present in the hemicellulose.

It is known that treatment with alkali darkens the lignocellulosic material. The extent to which the material is darkened increases with increasing temperatures and alkali content, and is extremely troublesome at temperatures above 100° C. However, when the alkaline softener is combined with an organic or inorganic peroxide, this darkening of the material is counteracted while greatly improving, at the same time, the potential of the fibre material for increased brightness during a bleaching stage or a refining stage. The peroxide, in itself, also has a softening effect on the fibre material, and is thus also positive in this respect.

Hydrogen peroxide has its decomposition maximum at a pH of about 11.6. If the ratio between alkali and peroxide during the impregnation process is selected so that the pH approaches this value prior to, during, and immediately after the impregnation phase, the peroxide present will decompose while generating oxygen gas. Such reactions impair impregnation, due to the fact that the bubbles of gas generated in the voids present in the fibre material renders penetration of the impregnating solution difficult. This generation of gas can also result in impregnating liquid which has already entered the chips being expelled therefrom.

It has been found, in accordance with the invention, that these negative reactions from the aspect of impregnation can be eliminated by selecting the ratio of alkali to peroxide so that the pH of the solution differs markedly from the optimal pH for peroxide decomposition.

It is not sufficient, however, simply to choose the ratio of alkali to peroxide so that the pure impregnating solution is stable. Since the wood contains a number of acid components, such as uronic acid groups and acetyl groups, the quantitative presence of which varies with the type of wood used, part of the alkali supplied is very quickly consumed in the ensuing neutralizing reactions. If an excess of alkali is introduced into the impregnating solution so as to hold the pH of the liquid which has penetrated the chips above the pH for maximum decomposition, even though a certain amount of alkali has been consumed in neutralizing reactions, i.e. a pH above 12, it is possible with the aid of conventional impregnating apparatus to impregnate factory-cut chips with a mixture of sodium hydroxide and peroxide. In this respect, there is normally required a weight relationship between the sodium hydroxide and hydrogen peroxide charged to the system of ≧2.5. The wood material should then have a pH of 7–11, preferably 8–10, after the impregnating stage.

As an example of the effect which the relationship between sodium hydroxide and peroxide has on the bleaching result, the bleaching result has been shown in Table I below as the amount of liquid taken-up in liters per ton of bone-dry chips when impregnating fresh birch chips.

TABLE I

| | Co-impregnation | |
|---|---|---|
| Sample No. | $H_2O_2$ % by weight of total amount NaOh + $H_2O_2$ | Liquid take-up liter/ton bone-dry chips |
| 1 | 0 | 830 |
| 2 | 15 | 800 |
| 3 | 25 | 730 |
| 4 | 35 | 500 |
| 5 | 50 | 400 |
| 6 | 75 | 300 |
| 7 | 100 | 730 |

The time taken to effect impregnation may be varied between 2 and 60 minutes, preferably between 2 and 10 minutes, in order to achieve good penetration of impregnating liquid into the chips.

The solution of impregnating chemicals can be further stabilized, by adding some form of silicon compound, such as water-glass for example.

Since, however, the presence of silicous material results in incrustation of the process apparatus, particularly on the hot surfaces of the beating apparatus, the use of such material should be avoided, since when balancing the ratio of sodium hydroxide to peroxide in the impregnating solution, as proposed by the present invention, such stabilization is unnecessary. Impregnation can be effected either with or without the addition of organic complex builders, such as EDTS, DTPA, Dequest or the like.

Subsequent to being impregnated, the chips are permitted to react for periods of from 0 to 60 minutes, in certain cases up to 90 minutes, preferably for periods of between 5 and 30 minutes, at temperatures of between 20° and 100° C., preferably between 60° and 90° C.

The invention will now be described in more detail with reference to an exemplifying embodiment thereof and in conjunction with the accompanying drawing, the single FIGURE of which is a block schematic illustrating co-impregnation with alkali and peroxide.

EXAMPLE 1

Screened fresh chips produced from birch, *Betula Verrucosa,* were steamed in a steaming vessel 1 (of FIGURE) with water steam at atmospheric pressure (100° C.) for a period of 10 minutes, and were then immediately treated with an impregnating solution in a number of different ways. In a first instance, the chips were immersed in a tank 2 containing an impregnating solution which comprised an aqueous solution of sodium hydroxide, with or without hydrogen peroxide. The temperature of the solution at the time of immersing the chips was 20° C., and should be held between 15° and 60° C. The impregnating time was 10 minutes. In another instance, the chips were impregnated in a screw press 3.

The impregnated chips were drained, step 4, for three minutes at 20° C. or thereabove, and were then conveyed to the pre-heater 5 of the refiner, where they are treated with heat at 80° C. for 15 minutes. It is important that the temperature does not exceed 100° C. when pre-heating the chips. Subsequent to being pre-heated, the chips were beaten in a twin-disc atmospheric refiner 6, "Sund-Bayer 36".

The weight ratio of impregnating liquid to wood was 7.5 to 1, with the wood calculated as bone-dry chips. Subsequent to being refined, the pulp had a dry solids content of 22% and had a pH of 7.4–7.8 when the sodium hydroxide charged was in excess of 4% by weight calculated on bone-dry chips.

The properties of the unbleached pulp, with the exception of brightness, were determined immediately after refinement of the pulp in accordance with SCAN-methods, after removing latency. The results are compiled in Table II. The brightness of the pulp was determined with the aid of a strong sheet, giving a brightness value which is some units lower than that obtained when determining brightness in accordance with SCAN-methods on sheets of high grammage produced on a Büchner funnel.

Parts of the pulps were also bleached with hydrogen peroxide after latency removal. The pulps were bleached on a laboratory scale with varying quantities of hydrogen peroxide and sodium hydroxide, sodium silicate and an organic complex builder, Diethylene Triamine Pentaascetic Acid (DTPA) in such proportions with respect to the amount of hydrogen peroxide charged as to obtain maximum brightness. The results are compiled in Table III. The laboratory bleaching processes 7 where carried out at a temperature of 60° C., for two hours at a pulp concentration of 12%. The properties of the bleached pulp were also analysed in accordance with SCAN-methods, with the exception of brightness as in the aforegoing.

TABLE II

| | Unbleached Pulp | | | | | | | | |
|---|---|---|---|---|---|---|---|---|---|
| Sample No. | NaOH charged weight % on bone-dry chips | $H_2O_2$ charged weight % on bone-dry chips | Energy input kWh/ton CSF-100 ml | Tensile index kNm/kg | Tear index $Nm^2/kg$ | Density $kg/m^3$ | Brightness % ISO | Light scattering coefficient s $m^2/kg$ | Light absorption coefficient s $m^2/kg$ |
| 8 | 4.7 | — | 820 | 38.6 | 4.9 | 440 | 37.2 | 35.6 | 9.1 |
| 9 | 3.6 | 0.7 | 960 | 25.7 | 3.5 | 370 | 48.0 | 42.1 | 5.1 |
| 10 | 5.4 | 1.4 | 810 | 35.4 | 4.7 | 415 | 44.2 | 39.6 | 6.4 |

TABLE III

| Sample No. | $H_2O_2$ charged weight % on bone-dry pulp | NaOH charged weight % on bone-dry pulp | Water-glass charged weight % on bone-dry pulp | DTPA charged weight % on bone-dry pulp | Tensile index kNm/kg | Tear index $Nm^2/kg$ | Density $kg/m^3$ | ness % ISO | s $m^2/kg$ | k $m^2/kg$ |
|---|---|---|---|---|---|---|---|---|---|---|
| | | | | Bleached Pulp | | | | | | |
| 8:1 | 3 | 1.3 | 4 | 0.2 | 34.8 | 5.0 | 415 | 70.0 | 35.0 | 1.94 |
| 8:2 | 4 | 1.5 | 4 | 0.2 | 36.1 | 5.8 | 425 | 73.0 | 34.6 | 1.71 |
| 9:1 | 3 | 1.4 | 4 | 0.2 | 28.4 | 3.8 | 385 | 74.8 | 40.0 | 1.54 |
| 9:2 | 4 | 1.6 | 4 | 0.2 | 28.1 | 4.0 | 390 | 77.0 | 38.9 | 1.37 |
| 10:1 | 3 | 1.3 | 4 | 0.2 | 36.9 | 4.5 | 430 | 77.2 | 35.3 | 1.19 |
| 10:2 | 4 | 1.5 | 4 | 0.2 | 37.0 | 4.8 | 440 | 79.3 | 34.4 | 0.93 |

When in accordance with the invention, peroxide is applied to the chips prior to defibrating and refining the same, two decisive advantages are obtained technically. The first of these reside in a reduction in the darkening of the material introduced when impregnating the chips with alkali, while the second resides in counter-action of the darkening effect of the high refining temperature to which the chips are exposed. Both these favourable factors also contribute towards improving substantially the potential of the pulp of a further incresse in brigthness when subjected to conventional bleaching with peroxide in a subsequent stage.

The system according to the invention enables this to be done with moderate peroxide charges and in the absence of silicious stabilizers, which makes the process less expensive and also eliminates the problems of incrustation, a problem created by silicates in both the pulp and the paper industries.

By complementing the system according to the invention with conventional tower bleaching, it is possible by dividing a given amount of peroxide optionally between the impregnation of chips and tower bleaching of pulp, either to reduce the total amount of peroxide to a given brightness, or—which is probably of greater interest—by charging moderate quantities of peroxide, optimally distributed, to obtain a finished pulp which has a brightness far in excess of that obtainable with the aid of present-day established techniques.

The system according to the invention is based on an advanced impregnating technique which enables the use of conventional factory-cut chips without requiring the chips to be reduced in size prior to being impregnated.

Another valuable aspect of the system according to the invention is that the impregnating chemicals used, sodium hydroxide and peroxide, react optimally with respect to their respective purposes at temperatures beneath 100° C. Present day techniques are based on the use of chemicals whose optimal reaction temperature in this type of application lies considerably above 100° C.

When applying the invention, this difference in temperature enables energy input to be lowered during the impregnating phase and also imparts to the chips properties such that the energy requirement during the refining stage is also low, 600–1000 kWh/ton in a freeness range of 300–100 ml.

What we claim is:

1. In a method of manufacturing chemimechanical pulp from lignocellulosic material, comprising steaming the material and impregnating the same with alkali and peroxide, and subsequently draining, pre-heating, refining and bleaching said material; the improvement in which said impregnating is effected with a solution which contains alkali and peroxide in a weight ratio at least equal to 2.5:1 for a period of 2 to 20 minutes, to said draining is effected for 5 to 60 minutes at a temperature about between 20° and 100° C., and said pre-heating is effected at a temperature between 50° and 100° C., and a pH of 7–11.

2. A method according to claim 1, in which the material is impregnated by immersing said material in an impregnating soluton for a period of up to about 10 minutes at a temperature of 15°–60° C.

3. A method according to claim 1, in which said draining steps is effected for a duration of 5–25 minutes, so as to allow time for the alkali and peroxide to react with the material in a vessel at a controlled temperature of about 60°–90° C.

4. A method according to claim 1, in which said refining is effected in an open refiner at substantially atmospheric pressure.

5. A method according to claim 1, in which the ratio of the alkali and peroxide is balanced in a manner such that after pre-heating and prior to refining, the pH of the material is about 8 to 10.

6. A method according to claim 1, in which a total amount of charged peroxide for impregnation and final bleaching is distributed between impregnation and final bleaching in such a way as to impart maximum brightness to the bleached pulp.

* * * * *